United States Patent [19]

Schwab

[11] 3,931,719

[45] Jan. 13, 1976

[54] JEWELRY COMPONENT HAVING MOUNTED STONES CONNECTED BY DEFORMABLE WEBS

[75] Inventor: Kurt Schwab, Innsbruck, Austria

[73] Assignee: D. Swarovski & Co., Glasschleiferei, Austria

[22] Filed: Apr. 27, 1973

[21] Appl. No.: 355,361

[30] Foreign Application Priority Data

May 3, 1972 Austria ..... 3852/72
Mar. 29, 1973 Austria ..... 2781/73

[52] U.S. Cl. ..... 63/28; 29/160.6; 63/2; 156/8

[51] Int. Cl.[2] ..... A44C 15/00; A44C 27/00

[58] Field of Search ..... 63/2, 28, 20; 29/160.6; 161/7

[56] References Cited

UNITED STATES PATENTS

| | | | |
|---|---|---|---|
| 195,304 | 9/1877 | Pic et al. | 63/2 X |
| 225,816 | 3/1880 | Fischer | 63/28 |
| 802,267 | 10/1905 | Chaumet | 63/28 |
| 860,204 | 7/1907 | Fishel | 63/28 |
| 964,625 | 7/1910 | Doran | 63/28 |
| 1,854,958 | 4/1932 | Santosuosso | 63/28 |
| 1,958,946 | 5/1934 | Gautieri | 63/28 |
| 2,080,317 | 5/1937 | Jaeckel | 63/28 |
| 2,163,814 | 6/1939 | Swarovski | 63/28 UX |
| 3,154,841 | 11/1964 | Krikorian | 29/160.6 |

*Primary Examiner*—F. Barry Shay
*Attorney, Agent, or Firm*—Toren, McGeady and Stanger

[57] ABSTRACT

Jewel-studded components are formed of a planar holder or carrier made up of rings joined together by webs with the back surfaces of stones secured into the rings by soldering or by an adhesive. The thickness of the holder is only a fraction of the height of the back surface of the stones. The rings are sized to receive the shape and size of the stones so that different size stones can be fitted into the holder. The holder can be formed from a thin metal plate and the webs are flexible and deformable. Further, the holder can be provided with support surfaces, laterally adjacent the rings, on which contrasting small sized articles, such as granules or floccules, are deposited.

1 Claim, 17 Drawing Figures

JEWELRY COMPONENT HAVING MOUNTED STONES CONNECTED BY DEFORMABLE WEBS

SUMMARY OF THE INVENTION

The present invention is directed to the formation of a jewel-studded component and, more particularly, it is directed to the construction of such a component formed of rings secured together by webs so that a thin planar holder is provided into which stones can be secured.

The production of both fine and custom jewelry from strass-chatons can be effected in various ways. Previously, the stones were held in mounts by claws, however, today most stones are cemented in position.

A considerable portion of the custom jewelry produced uses so-called kettle chains. These kettle chains are metal parts deformed into mounts which are joined together by links. The kettle chains are very flexible and can be joined to each other by soft or hard soldering and they can be subsequently galvanized. This type of custom jewelry has the disadvantage that the claws used for mounting the stones remain visible and the stones are spaced relatively far apart and do not afford the impression of a continuous or closed surface.

In another type of jewelry production, metal parts are produced by centrifugal casting and are then galvanized with the stones being set individually by hand. This method has the disadvantage that the front facets of the stones are soiled by the adhesive. Though the adhesive is mostly transparent, the appearance of the stones is greatly impaired because the adhesive changes the physical properties of the upper facets, and the effect of the surface-ground faces, which impart fire and brilliance to the stones, is lost. Another disadvantage of this method is the high cost of labor. Since in the production of custom jewelry certain price levels must not be exceeded, it has frequently been tried to reduce the high processing costs by using larger stones. However, the use of larger stones impairs the appearance of the jewelry. Such pieces lack the delicacy and elegance of fine jewelry.

By means of the present invention it is possible to eliminate the disadvantages experienced in the past. In accordance with the present invention, the jewelry is produced, not by cementing individual stones into mounts, but by prefabricating the stones and combining them in groups to form a jewelry component. Such components can then be supplied to a manufacturer so that he can produce the jewelry by combining several components, for example, by cementing or sewing. Since the components must have certain properties, the present invention is directed to the components and the manner in which they are produced. The components embodying the invention consist of stones secured in rings joined to one another by webs to form a planar or flat-shaped holder or carrier, the thickness of the rings forming the carrier are only a fraction of the height of the back surfaces of the stones which are fitted into the rings. The shape and size of the rings are adapted to the shape and size of the stones fitted into the rings. The carrier can be in a leaf or band shape, but it can also be formed to a particular pattern. It is not necessary for the component to be flat and it can be deformed to the configuration of the object to be decorated, for example, to the shape of a button, a buckle and the like.

The stones can be cemented or soldered to the rings of the carrier, and where soldering is used the back surfaces of the stones are provided, at least in part, with a metal coating. In most cases the diameter of the rings forming the carrier will be smaller than the maximum diameter of the stone so that the ring is not visible when viewed from the front surface of the stones. By virtue of the stone setting afforded by the present invention, it is possible to form components with the stones in a closely fitted arrangement and with a maximum amount of flexibility and deformability being present in the component.

In producing the components, initially the stones are placed on a vibrating plate so that the stones fall into depressions shaped to receive the back surfaces of the stones. With the depressions filled with stones, the remaining stones on the plate are removed. The depressions in the vibrating plate are arranged in a pattern comparable to at least a portion of the pattern of the rings in the holder or carrier. The stones are transferred to a settling plate and are fixed to the carrier which is applied onto the back surfaces of the stones after the stones have been inverted from their position in the vibrating plate. The mechanical arrangement of the stones and the fixing of the stones to the carrier is subject to modifications.

Additionally, the invention concerns the manner in which the holders are formed, such as by etching a thin metal plate to provide the arrangement of the rings and webs which define the holder.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
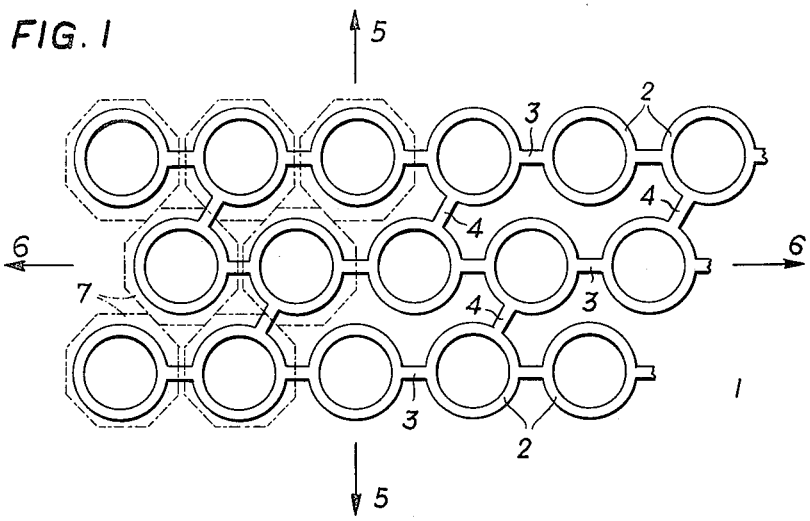
FIG. 1 is a plan view of a carrier with certain of the stones shown in phantom.
Figure 2:
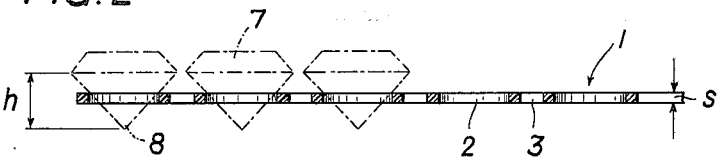
FIG. 2 is a sectional side view of the holder shown in FIG. 1.

IN FIGS. 1 and 2, a holder 1 having a screen-like appearance, is formed of a plurality of rings arranged in three lingitudinally extending rows with the rings in each row joined together by webs 3, that is, in each row adjacent rings are secured together by a web 3. The webs 3 are disposed in longitudinal alignment. Additional webs 4 interconnect certain of the rings in adjacent rows. The webs 4 extend obliquely between the rings relative to the longitudinal direction of the webs 3. As can be seen in FIG. 1 every other ring in the rows is secured by a web 4 to a ring in the adjacent row. Accordingly, it is possible to stretch the holder 1 in the direction of the arrows 5 because of the orientation of the webs 4, however, because of the longitudinal alignment of the webs 3 it is not possible to effect an expansion in the direction of the arrows 6.

Because of the type of materials used, the components formed of the carriers 1 and stones 7 can be formed into developable surfaces, for example, cylinders, cones and the like, by deforming the component in any direction. While the component is being deformed, the stones remain fixed to the rings and the rings are mechanically unstressed, because only the connecting webs 3 and 4 are bent or twisted in the deforming operation. This characteristic is of particular importance because warping of the rings is prevented and the stones do not become displaced or broken out of the rings during the deformation operation.

As indicated in FIG. 2, the stones 7 are set into the rings 2, the stones being shown in dot-dash lines. At the maximum diameter of the stones a separating plane is provided extending generally parallel with the surface of the holder with the front surface of the stone extending outwardly from one side of the separating plane and the back surface of the stone extending outwardly from the opposite side of the separating plane. As shown in FIG. 2, the back surface of the stone seats within the rings 2 in the carrier 1. In FIG. 2 the height $h$ of the back surface of the stones 7, that is, the dimension from the separating plane to the tip 8 of the stone is considerably greater than the thickness $s$ of the carrier, that is, the thickness of the carrier represents only a fraction of the height $h$ of the back surface of the stone.

The inside diameter of the rings 2 is not critical. If a smaller inside diameter is used for the rings, the back surfaces of the stones are engaged closer to the tip 8 without causing any effect on the properties of the component.

As indicated by the dot-dash lines in FIG. 1, the stones can be arranged closely together giving the surface of the component formed by the front surfaces of the stones a solid or closed impression. Such a close arrangement of the stones was not possible in the known methods of stone setting. With metal kettles and plastic mounts the edges of the stones had to be fixed so that a corresponding distance between adjacent stones was unavoidable. With the components formed in accordance with the present invention, the closest arrangement of the stones can be achieved by orienting the stones by the use of suitable devices in such a way that the corresponding facets point in the same direction.

Figure 3:
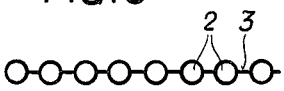
FIGS. 3 to 7 are schematic showings of a variety of band-shaped holders.
Figure 4:
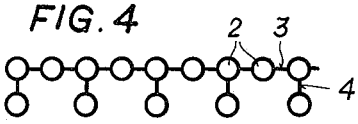
Figure 5:
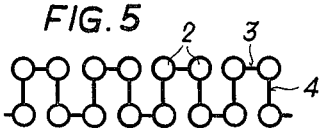
Figure 6:
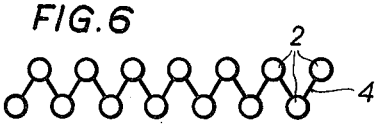
Figure 7:
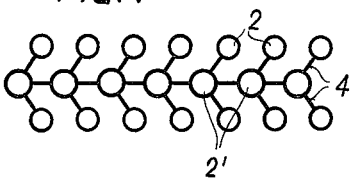

The screen-like holders for the stones can be formed of various materials. It is simple to produce the holders by etching. In etching a holder, a suitable thin metal sheet is coated on both sides, for example, with "PHOTO-RESIST", after which the desired shape of the holder is projected on the coated surfces. After development, the etching can be carried out, an etch-absorbing varnish can be applied by means of a screen printing process. As a result, the uncovered areas are etched away and the desired holder remains. The shape of the holder can vary, as is indicated in FIGS. 3 to 8. In FIG. 3 the holder is formed of a single row of rings 2 joined by webs 3. In FIG. 4 one continuous row is formed, similar to that in FIG. 3, with every other one of the rings in the continuous row being connected to another ring by a web 4. In FIGS. 5 and 6 two adjacent rows of rings 2 are provided, however, in FIG. 5 alternate pairs of rings are secured together by the webs 3 while each of the adjacent pairs of rings are secured by the webs 4 so that the webs connect the rings together in a tortuous or meandering form. In FIG. 6 the rings in one row are offset relative to the rings in the adjacent row and while the rings in the individual rows are not connected together the rings in adjacent rows are interconnected by webs 4 providing the holder with a zigzag appearance. In FIG. 7 three rows of rings are shown with the center row having larger rings 2′ as compared to the rings 2 in the two outer rows. Only the rings 2′ are connected together in a longitudinal form similar to that in FIG. 1 with obliquely disposed webs 4 joining each of the rings 2′ in the center row to an adjacent ring in ech of the two outer rows. The rings in the outer rows are not connected to one another but only to the rings in the center row. In the arrangement of FIG. 7 larger stones can be inserted into the center row. Due to the manner in which the rings in the outer row are joined to the rings in the center row the carrier has a herringbone pattern. The inside diameters of the rings in each of the rows are preferably adapted so that the outer faces of the small and the large stones are arranged in the same plane. With such an arrangement components with stray stones can be produced.

Figure 8:
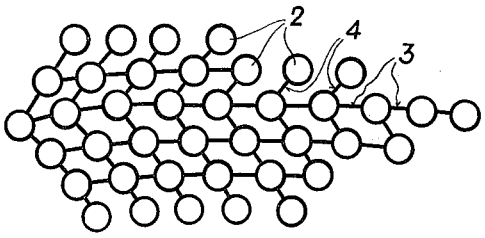
FIG. 8 is a schematic showing of a shaped holder.
Figure 9:
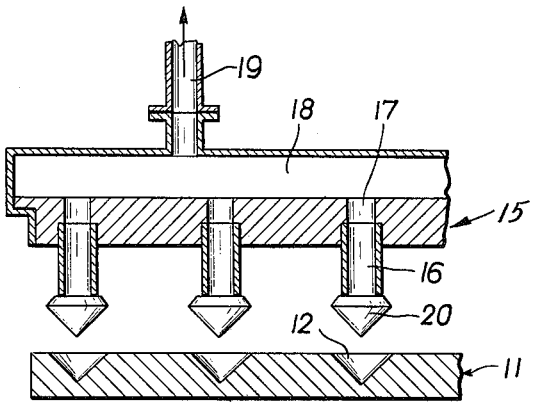
FIGS. 9 to 12 illustrate the various steps involved in forming a jewelry component using a holder of the type shown in FIG. 1.
Figure 10:
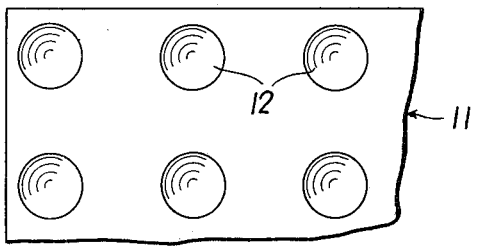
Figure 11:
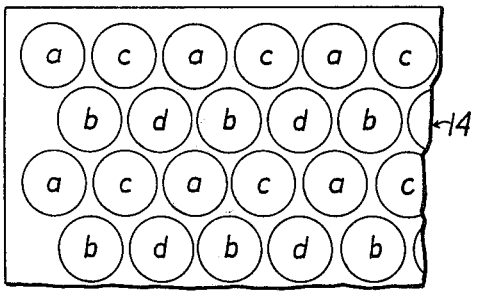
Figure 12:
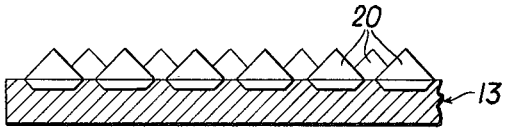

Though the components shown in FIGS. 3 to 7 have basically a band-like configuration, from FIG. 8 it can be noted that shaped holders can be provided, such as the leaf-shaped holder indicated. The holder in FIG. 8 can be easily deformed so that different leaf forms can be produced from one component. To provide the desired flexibility the rings in each of the longitudinally extending rows are not connected to one another by the webs 3 but are connected to rings in adjacent rows by the webs 4. A considerable reduction in the costs of production can be achieved if the stones are set mechanically into the rings of the holder. The setting operation is shown schematically in FIGS. 9 to 12. In FIG. 9 a vibration plate 11 is shown having depressions 12 arranged in a regular pattern and shaped to receive the back surfaces of the stones 7. Initially, the stones are placed on the vibration plate 11 and by shaking the plate they fall into the depressions 12. With the depressions filled, any remaining stones are removed from the plate. A turning plate 13, as indicated in FIG. 12, can be placed over the front surfaces of the stones in the plate 11 and, by inverting both of the plates, the vibration plate can be removed with the stones 20 fitted within recesses in the turning plate with their back surfaces directed upwardly. When inverted in the transfer or turning plate 13, the stones remain in the pattern as originally contained in the vibration plate and as is shown in FIG. 10. A holder 1 can be applied to the back surfaces of the stones and soldered or cemented to them. With the stones secured to the holder, the component can be lifted as a unit from the turning plate 13.

If the stones are to be arranged closely together, shaking the vibration plate for positioning the stones in the depressions can present some difficulties. If the depressions are arranged closely together the stones tend to block the movement of one another and, as a result, the use of such a vibration plate is unsuitable. Accordingly, to provide a close arrangement of the stones, an intermediate plate 14, such as shown in FIG. 11, can be used. The plate 14 contains depressions spaced closely togethr with the depressions arranged in a multiple of the pattern shown in FIG. 10. By initially using the vibration plate with the wide spacing of the depressions it is possible to displace the stones into the depressions and then lift the stones and place them in the various patterns indicated in FIG. 11.

In arranging the stones in the depressions in the plate 14 shown in FIG. 11, initially, the stones are lifted from the vibration plate 11 by means of a transfer plate 15 and located in the selected depressions in the settling plate 14. The plate 15 has tubes 16 soldered in place within bores 17 in the plate. The upper face of the plate forms a housing 18 which is connected over a hose line 19 to a vacuum pump, not shown. By exerting a vacuum within the pump and positioning the tubes over the stones in the vibration plate, the stones can be lifted in the desired pattern from the plate 11 and moved into position over the settling plate 14. When the stones are positioned in the selected depressions, for instance depressions *a* of the settling plate, the suction pump can be disconnected and the stones will remain in the settling plate 14 when the transfer plate 15 is removed.

This process is repeated a number of times by the transfer plate, however, each time it is displaced diagonally relative to the prior position for depositing the stones from the vibration plate so that the stones are located in a different pattern of depressions. For instance, in the second step of the operation, the stones are placed in the depressions *b*, the next set of stones is placed in the depressions *c* and the final set of stones is placed in the depressions *d* so that all of the depressions in the settling plate 14 are filled with stones.

By using the turning plate 13 the stones can be inverted while they are kept in the proper arrangement and the holder can be cemented to the back surfaces of the stones. It may be advisable to equip the turning plate with a vacuum device, in the same manner as the transfer plate 15. Different vibration plates and transfer plates are used if stones of different size and/or different color are to be combined in a component. A separate vibration plate and in many cases also a separate feed plate must be used for each size and for each color of the stones.

In another feature of the invention, surfaces can be provided on the holder which are free of stones and are made optically effective. This can be achieved by providing support surfaces adjacent the rings and, after depositing an adhesive coat on the surfaces, sprinkling or applying small sized materials such as floccules, granules, spherules, fibers and the like. For this purpose metal pigment floccules are suitable, as are textile fibers. Moreover, glass chips can also be used. With this arrangement the portions of the components which do not contain stones provide a sharp contrast with the stones.

Figure 14:
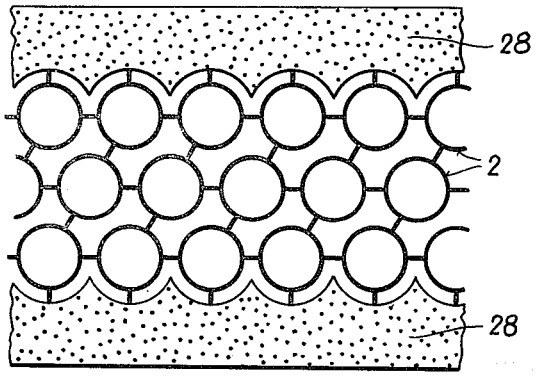
FIGS. 14 to 17 are plan views of decorative holders embodying the present invention.

In FIG. 14 a portion of a strip or band-shaped holder is shown with two edge zones or support surfaces 28 flocked with small material after the stones have been inserted.

Figure 15:
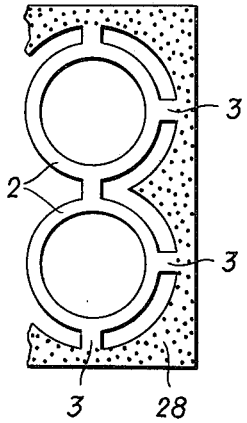

In FIG. 15 adjacent rings are secured to one another by webs 3 and are also secured to the adjacent surfaces 28 by similar webs. In other words, the webs extend perpendicularly to one another from opposite sides of the rings.

Figure 16:
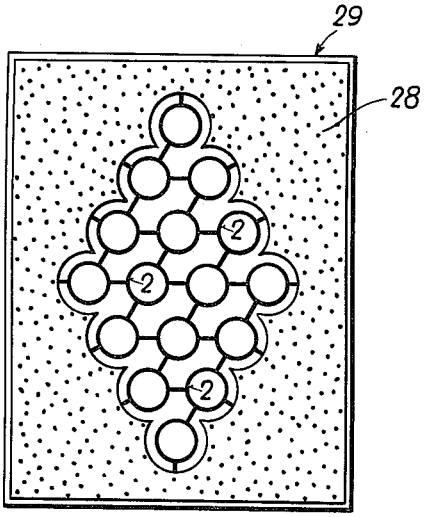

In FIG. 16 a carrier 29 is illustrated which is made up of sixteen rings arranged in a rhombic form but the support surface 28 laterally enclosing the rings has a rectangular shape and is flocked with a coat to provide a contrast with the stones in the rings.

Figure 17:
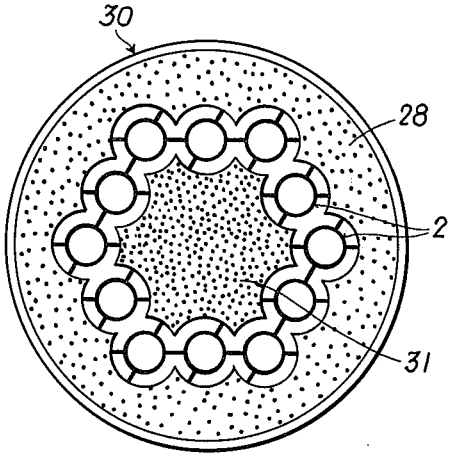

In FIG. 17 a circular holder 30 is illustrated with the rings 2 arranged in a circle laterally enclosed by a support surface 28 and, in turn, enclosing a center support surface 31. Both of the support surfaces 28 and 31 are provided with a coat of small material.

In the embodiment of FIGS. 14–17, the components are deformable to a limited degree. Although the components of these embodiments are not as deformable as those of FIGS. 1, 6, 7, and 8, they are deformable to some degree so as to allow for differently formed structures.

Figure 13:
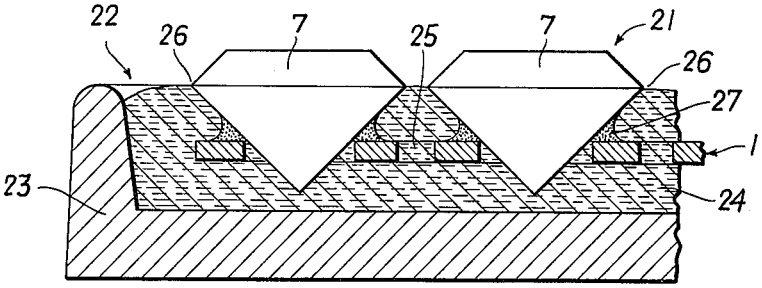
FIG. 13 is a partial sectional view through a piece of jewelry formed in accordance with the present invention.

Jewelry pieces can be formed by inserting components 21 in depressions provided in or on a jewelry piece or carrier 23 into which adhesives 24 are introduced, note FIG. 13. The thickness of the adhesive is selected so that it penetrates through openings 25 in the holder 1, which openings are located between the webs, and permits the adhesive to wet the stones up to the edge 26, that is to the separating plane which defines the back surface from the front surface of the stones.

Preferably, solvent-free adhesive systems or casting resins are used so that there is no shrinkage as the material sets and an optimum bond is obtained. The components formed in accordance with the present invention are flexible and partly stretchable and during such deformation the stones are not disturbed relative to one another. Stray stones can also be set and any desired form can be given to the components. It is possible to produce the components in leaf or band form and the manufacturer can eliminate parts as desired, such as is done in the "do-it-yourself" market. Accordingly, preset breaking points can be provided in the webs of the holders. It is also possible to cut the webs apart, for instance, by a separating disc or suitable pliers such as diagonal cutting pliers. Further, there is great freedom in the selection of the adhesive used.

The cross section of the ring 2 of a holder must be selected so that, when the holder is bent or stretched, only the webs are deformed and not the rings.

It is not necessary that the rings be circular. In certain cases it is feasible to adapt the ring form and/or the ring cross section to the stone to be inserted.

Further, the components formed in accordance with the present invention have the advantage that they can be used even with small sized stones, which is not possible with kettle mounts or plastic.

During subsequent galvanizing, the back surfaces of the stones with their sensitive varnish or silver mirror coats are completely protected by the adhesive or resin in jewelry pieces formed in accordance with the present invention. However, in kettle mounts the back surfaces are exposed which often leads to problems with the silver mirror coat, because the cleaning process preceding the galvanizing bath, which incidently is carried out differently by various processors, represents an extremely rough treatment of the stones.

In single-row holders, the connecting webs of the individual rings can be made thicker to increase the stability of the component. This characteristic also applies to all special forms of the components.

With the present invention it is also possible to produce crowned, that is convex or concave components, such as for buttons. For economy reasons flat settling plates are preferred. The form of the components depends on the type of deformation to be subsequently provided.

The use of the holders according to the present invention are by no means limited to strass chatons, pointed stones or transparent or opaque glass beads could also be used with the same advantages. The use of the vibration plates in forming the components is much simpler when glass beads are used instead of chatons. Further, in such a case the turning step is eliminated. It should be understood that the term "stones" used herein is intended to cover chatons, pointed stones, beads and the like.

The present invention opens up new possibilities in the custom jewelry field, for example, the production of largesurfaced highly flexible bangles, bracelets and clasps studded with jewels in a close arrangement. Such close spacing has not been economically feasible in the past because of the high processing costs involved, such as for individual stone setting, or because subsequent deformation of the previously formed components made with plastic was not possible. The great flexibility of finished jewelry pieces, such as is required for head and arm bands, is achieved, for example, by using the components formed in accordance with the present invention in combination with rubber-elastic two-component adhesives to cement the components with the carrier materials.

While specific embodiments of the invention have been shown and described in detail to illustrate the application of the inventive principles, it will be understood that the invention may be embodied otherwise without departing from such principles.

What is claimed is:

1. Jewel-studded components comprising a thin screen-like planar holder, said holder comprising at least two rows of rings, said rows being disposed in laterally spaced relation to one another, each said row having a plurality of rings disposed in spaced relation longitudinally of said row, and connecting means consisting of webs integrally interconnecting each said ring with at least one other of said rings, stones each having a separating plane with a front surface extending outwardly from one side of the separating plane and a back surface extending outwardly from the opposite side of the separating plane beyond said rings, and the back surface of each stone being secured in one of said rings, the thickness of said holder being only a samll fraction of the height of the back surface of each said stone measured outwardly from the separating plane, and the size and shape of said rings being adapted to the size and shape of said stones, said webs comprising first webs each connecting adjacent said rings of each of said respective rows, said first webs disposed in longitudinal alignment with each other in the respective row, and second webs extending obliquely of the longitudinal direction of said first webs and interconnecting adjacent said rings of different said rows so that one said first web and one said second web each connected to one said ring extend therefrom each to a said ring in a different said row, said webs being permanently deformable whereby the dimension of said component can be increased or decreased in a direction transverse to said longitudinal direction.

* * * * *